US005395119A

United States Patent [19]

Jacob et al.

[11] Patent Number: 5,395,119

[45] Date of Patent: Mar. 7, 1995

[54] WAGERING METHODS FOR BACCARAT

[76] Inventors: Douglas P. Jacob, 1024 Hollowbluff Ave., N. Las Vegas, Nev. 89031; Miguel A. Garcia, 5259 Caprice Ct., Las Vegas, Nev. 89118

[21] Appl. No.: 237,051

[22] Filed: Apr. 8, 1994

[51] Int. Cl.[6] ..... A63F 1/00

[52] U.S. Cl. ..... 273/274; 273/292

[58] Field of Search ..... 273/85 CP, 274, 292, 273/309, 138 R

[56] References Cited

U.S. PATENT DOCUMENTS

| | | | |
|---|---|---|---|
| 4,659,087 | 4/1987 | Shen et al. . | |
| 5,013,049 | 5/1991 | Tomaszewski . | |
| 5,072,946 | 12/1991 | Miller . | |
| 5,098,107 | 3/1992 | Boylan et al. . | |
| 5,100,137 | 3/1992 | Fulton | 273/274 |
| 5,141,234 | 8/1992 | Boylan et al. . | |
| 5,154,429 | 10/1992 | LeVasseur . | |
| 5,174,579 | 12/1992 | Griffiths . | |
| 5,226,661 | 7/1993 | Wolf . | |
| 5,257,810 | 11/1993 | Schorr et al. . | |
| 5,288,081 | 2/1994 | Breeding | 273/292 |

OTHER PUBLICATIONS

Berger, A. J., & Bruning, Nancy, *Lady Luck's Companion*, Harper & Row, 1979, pp. 257–260.

Miller, Len, *The Gambling Times Guide to Casino Games*, Carol Publishing Group, 1990, pp. 157–160.

*Primary Examiner*—Mark S. Graham
*Assistant Examiner*—William M. Pierce
*Attorney, Agent, or Firm*—Richard C. Litman

[57] ABSTRACT

Additional options for the placement of wagers in the game of baccarat are provided, to expand the potential interest and excitement of the game. The various betting or wagering options include different types of "surrender," in which a player may surrender a portion of his/her bet, depending upon the value or count of the first two cards of the player and banker hands, or only the player hand. The present invention also provides for the placement of bets on a "natural" hand(s), wherein a total count of eight or nine is achieved with only two cards, either of the banker or player hand. Other options are those of "super tie" wagers, in which a player may bet on player and banker hands of identical count which each have a predetermined value, and "jackpot" ties, similar to super ties but also requiring every card in the two hands to be of the same value, i.e., 4 or 6 of a kind. Yet another option is that of betting on the occurrence of flush hands, wherein all cards in the two hands are of the same suit. Methods of play using the above betting options are disclosed.

12 Claims, 4 Drawing Sheets

WAGERING METHODS FOR BACCARAT

FIELD OF THE INVENTION

The present invention relates generally to gambling and casino games, and more specifically to different and heretofore unused methods of betting in the card game of baccarat. The methods are adaptable to both standard and so-called "mini-baccarat" games, as well as to computer or electronic play, through provision of suitable software and algorithms.

BACKGROUND OF THE INVENTION

Risk taking and gambling have always been a part of human nature, and accordingly a multitude of games of chance have been developed to meet this need. Many such games involve cards, but most such card games involve play against another player, and one player's fortune is to at least some extent dependent upon the skill (or lack thereof) of the other player(s). Also, many, if not most such games, have relatively complex rules, which require the player(s) to engage in a fair amount of preparation and study in order to become proficient at the game.

Accordingly, simpler games have been developed, which require no appreciable amount of effort or thought on the part of the player(s). Baccarat, while having an aura of elegance, is one such game having relatively simple rules. However, the simplicity of the rules has led to a corresponding simplicity in the relatively few types of wagers which may be placed during the play of the game, which may limit interest on the part of the player(s) and thus further limit the casino in terms of profit and payout.

The need arises for a baccarat game providing for additional types of wagers over and above the standard bets, which are limited to betting on either the player or the banker hand, or in some games a tie between the two hands. The game should provide added interest by providing for "surrender" bets, in which a player may surrender half of his/her bet before the hand is played out, rather than risk losing all of the bet; "natural" bets, i.e., two cards having a total value of eight or nine; "super" tie and "jackpot" tie bets, in which not only is betting on a tie hand allowed, but also the specific count of the tied hands and (for jackpot ties) matching card values, e.g., four or six of a kind; and finally for flush hands, in which the four, five, or six card total of the player and banker hands are all of the same suit. While the rules of the game would remain the same, thus encouraging entry into the game by players without the time or inclination to learn a complex game, the different types of wagers permitted serve to add interest for those players who would enjoy making additional wagers on the game.

DESCRIPTION OF THE PRIOR ART

U. S. Pat. No. 4,659,087 issued to Margaret Shen et al. on Apr. 21, 1987 discloses a Casino Game which appears to combine elements of the games of blackjack (twenty one) and baccarat. The house or bank and the player(s) each receive four cards, which are divided into two pairs according to the rules. The player(s) hands are then compared to the bank or house hands to determine win, loss or tie. The only wagering mentioned is that of betting upon a win, loss or tie for either the player(s) or the house/bank. No bets on other aspects of the game are disclosed.

U.S. Pat. No. 5,013,049 issued to Joseph Tomaszewski on May 7, 1991 discloses a Card Game combining features of draw poker and blackjack; no resemblance to baccarat is seen. The only wagering provided is for a winning hand having the highest total without exceeding a predetermined limit, although the possibility is raised of payment for hitting the limit exactly. No bets for tie hands of any sort, flushes, etc. are provided, nor is there any provision for surrender, as in the present game.

U. S. Pat. No. 5,072,946 issued to Mark M. Miller on Dec. 17, 1991 discloses a Method Of Playing A Wagering Casino-Type Card Game. The game has some similarities to baccarat, but all of the face cards are removed from the deck in the preferred embodiment. Wagering is only described for winning and tie hands; no other wagering provisions of the present game are disclosed.

U.S. Pat. No. 5,098,107 issued to Eugene B. Boylan et al. on Mar. 24, 1992 discloses a Method And Apparatus For Playing A Wagering Game in which two levels of betting are provided simultaneously, one for the play of the standard game and another for the appearance of additional cards during the play of the hand. Boylan et al. also disclose wagers involving two cards of the same suit and/or "straights" of two cards, in the play of a blackjack type game, and standard poker type wagers (pairs and 3 and 4 of a kind), but only for an individual hand rather than for the combined player and banker hands. Boylan et al. also mention the use of their chance cards with other card games, including baccarat (col. 2, line 62). However, they consistently use the standard wagers and rules of the particular card game in combination with the additional chance cards of their disclosure. No suggestion is made of using any wagering methods from one game in another game.

U.S. Pat. No. 5,141,234 issued to Eugene B. Boylan et al. on Aug. 25, 1992 discloses a Method Of Playing A Wagering Game in which the cards have special symbols thereon. The relative values of the cards of different symbols in a hand are considered to determine the net value of the hand. Only winning or tie hand wagering is provided, although mention is made of a wager on the first two cards to be drawn for a hand. These wagers do not encompass all of the wager variations provided by the present invention, and do not consider the combination of both hands.

U.S. Pat. No. 5,154,429 issued to Richard A. LeVasseur on Oct. 13, 1992 discloses a Method Of Playing Multiple Action Blackjack, in which two hands are dealt rather than the standard single hand. Standard blackjack betting and/or playing procedures are disclosed, i.e., "doubling down," "splitting pairs," and "insurance." Each of these standard blackjack bets is made after the play of at least one card of the hand, whereas the present wagering methods (with the exception of surrender bets) are made before the play of each hand begins. LeVasseur makes no disclosure of any baccarat wagering or playing methods.

U. S. Pat. No. 5,174,579 issued to Steve Griffiths on Dec. 29, 1992 discloses a Modified Method Of Playing A Twenty One Game in which an additional wager is provided for the dealer's hand achieving a value of exactly twenty one. No other bets or wagers are provided for.

U. S. Pat. No. 5,226,661 issued to Fred Wolf on Jul. 13, 1993 discloses Methods Of Apportioning Game Wagers between a "bank" player and the remaining players of a card game. The disclosure specifically makes mention of the card game "Super Pan 9," although it is stated that the methods are adaptable to other games. No wagers relating to specific groups or patterns of cards are disclosed, as in the present invention. Rather, Wolf is directed to the determination of payoffs between a "bank" and other players depending upon the outcome of the bets or wagers, rather than on the type of wager made in the first place in a specific game, as in the present invention.

U.S. Pat. No. 5,257,810 issued to Steven A. Schorr et al. on Nov. 2, 1993 discloses a Method Of Playing A Blackjack Type Card Game in which a single dealer deals both the dealer's hand and a single player's hand common for all bettors, as in the game of baccarat. The disclosure makes mention of splitting pairs and doubling down, which types of wagers are standard in the game of blackjack, as well as "push" or tie bets. While the present invention provides for wagers on tie hands, the present invention is directed only to use with the game of baccarat, and does not modify the rules of play of that game. Moreover, the present invention includes far more different types of wagers than those disclosed by Schorr et al.

Lady Luck's Companion, by A. J. Berger and Nancy Bruning, published by Harper & Row in 1979, includes a discussion of the game of baccarat on pp. 257–260. The only bets disclosed are those on the banker's hand or the single player's hand to win; no other betting methods are disclosed by Berger and Bruning.

Finally, The Gambling Times Guide To Casino Games, by Len Miller, published by Carol Publishing Group in 1990, includes a discussion of baccarat and its rules of play on pp. 157–160. As in the Lady Luck's Companion publication, the only bets discussed are those placed on either the banker's hand or the single player's hand. No bets on ties or other bets are disclosed.

None of the above noted patents or publications, taken either singly or in combination, are seen to disclose the specific arrangement of concepts disclosed by the present invention.

SUMMARY OF THE INVENTION

By the present invention, improved wagering methods for the game of baccarat are disclosed.

Accordingly, one of the objects of the present invention is to provide improved baccarat wagering methods which generally expand upon the wagering options open to the players of the game.

Another of the objects of the present invention is to provide improved baccarat wagering methods which include a provision for surrender by a player, wherein the player may optionally surrender part of his or her bet depending upon the value of the first two upturned cards for both the player and banker hands.

Yet another of the objects of the present invention is to provide improved baccarat wagering methods which include an alternate provision for surrender, wherein the player may optionally surrender part of,his/her bet depending upon the value of the upturned cards for only the player hand, prior to exposing the banker hand.

Still another of the objects of the present invention is to provide improved baccarat wagering methods which include provisions for betting on "natural" hands, wherein either the player hand or the banker hand, or both, may each have a two card value totaling eight or nine.

A further object of the present invention is to provide improved baccarat wagering methods which include provision for betting on tie hands.

An additional object of the present invention is to provide improved baccarat wagering methods which include provision for betting on tie hands having a predetermined value or count.

Another object of the present invention is to provide improved baccarat wagering methods which include provision for betting on tie hands formed from identically valued cards, i.e., four or six of a kind, either for a single hand of play or for consecutive hands of play throughout the play of the "shoe," or multiple decks of cards in use.

Yet another object of the present invention is to provide improved baccarat wagering methods which include provision for betting on the occurrence of flush player and banker hands, i.e., both hands consisting of cards of the same suit throughout.

A final object of the present invention is to provide improved wagering methods in the game of baccarat for the purposes described which are inexpensive, dependable and fully effective in accomplishing their intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1A:
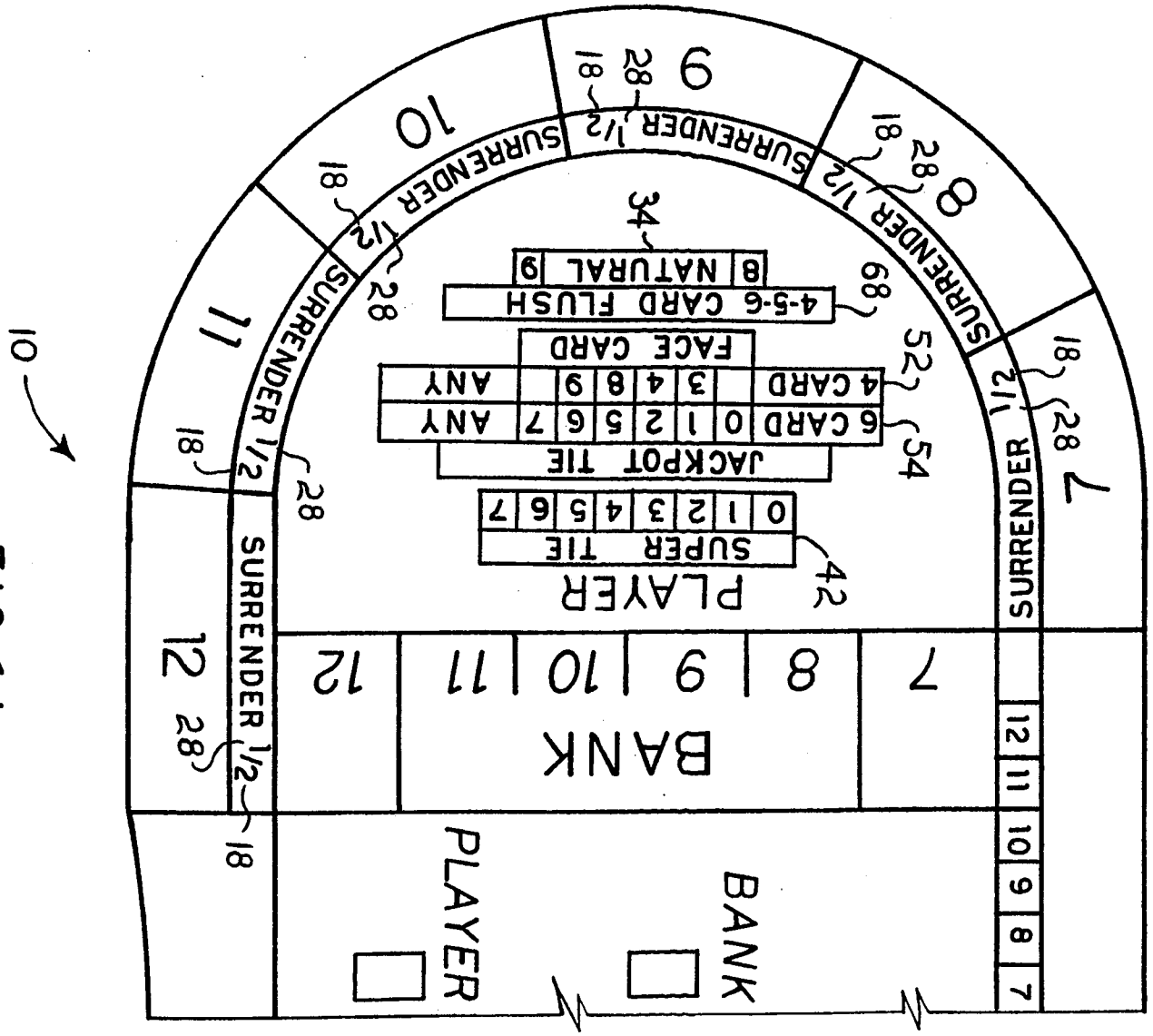
FIG. 1A is a plan view of a first half of a baccarat table, showing the general layout and provision for the betting methods of the present invention.
Figure 1B:
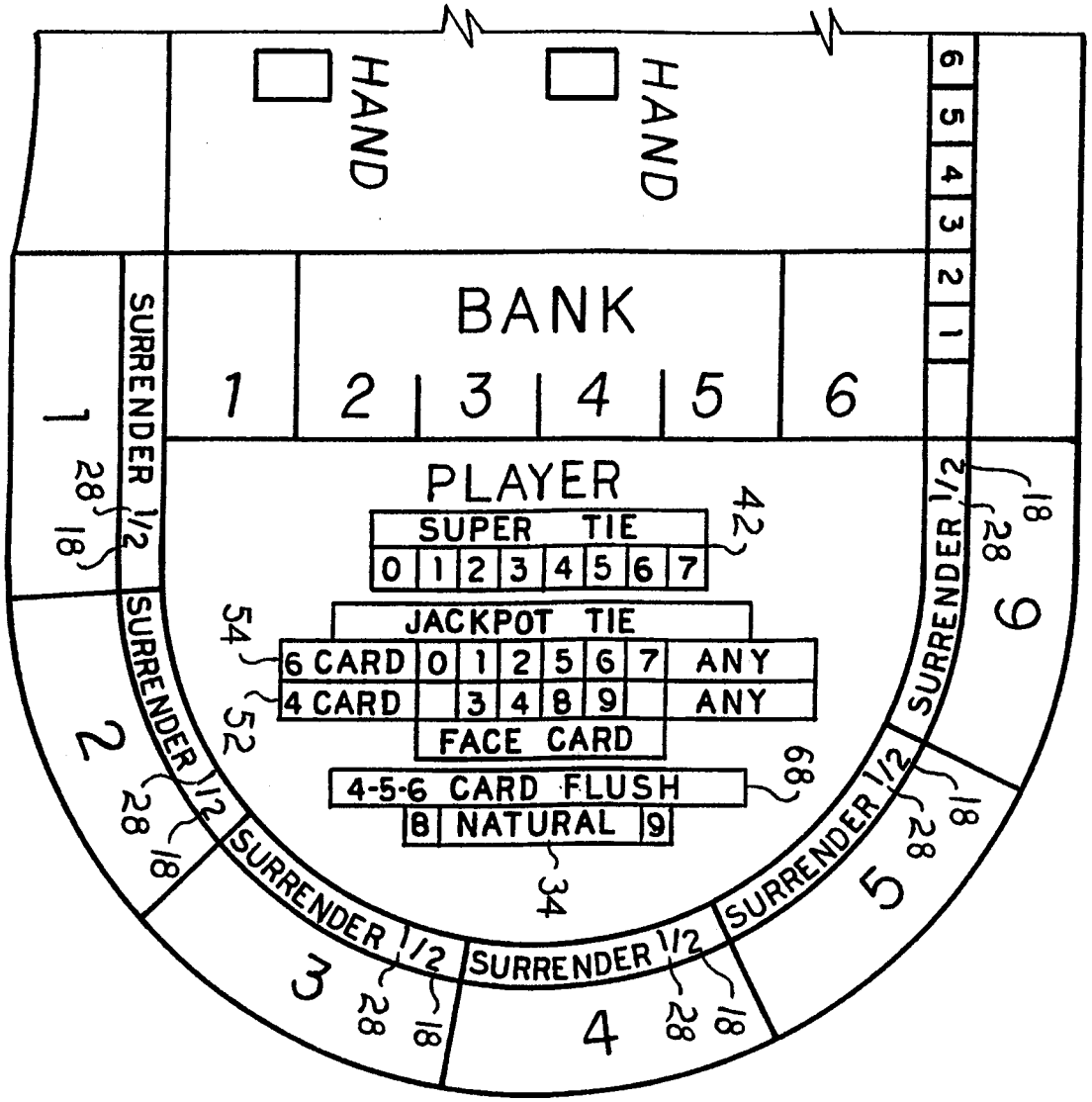
Figure 1B is a plan view of the second half of the above baccarat table, being generally a mirror image of FIG. 1A.
Figure 2A:
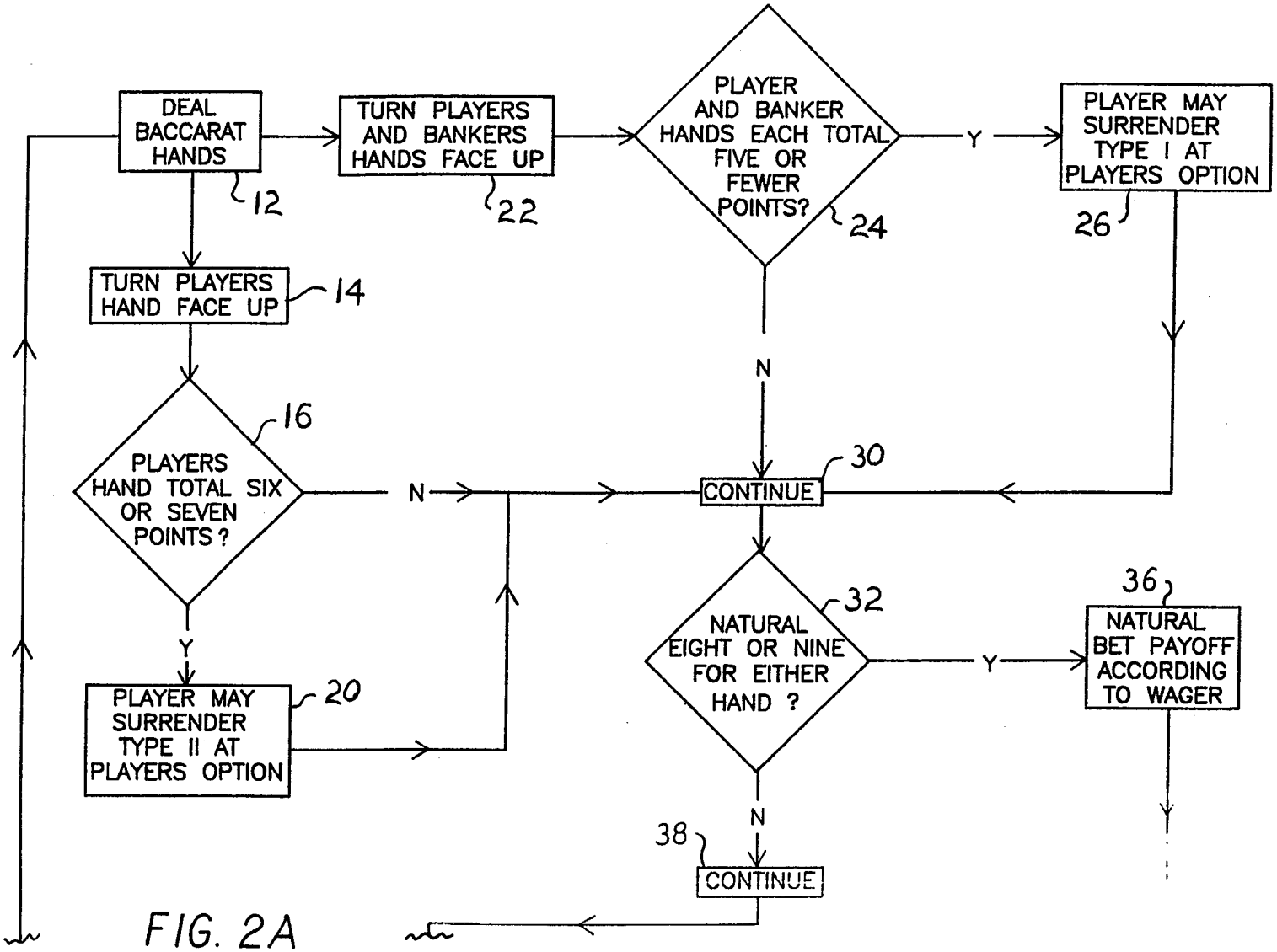
FIG. 2A is the first half of a flow chart disclosing the incorporation of the present betting methods in the game of baccarat.
Figure 2B:
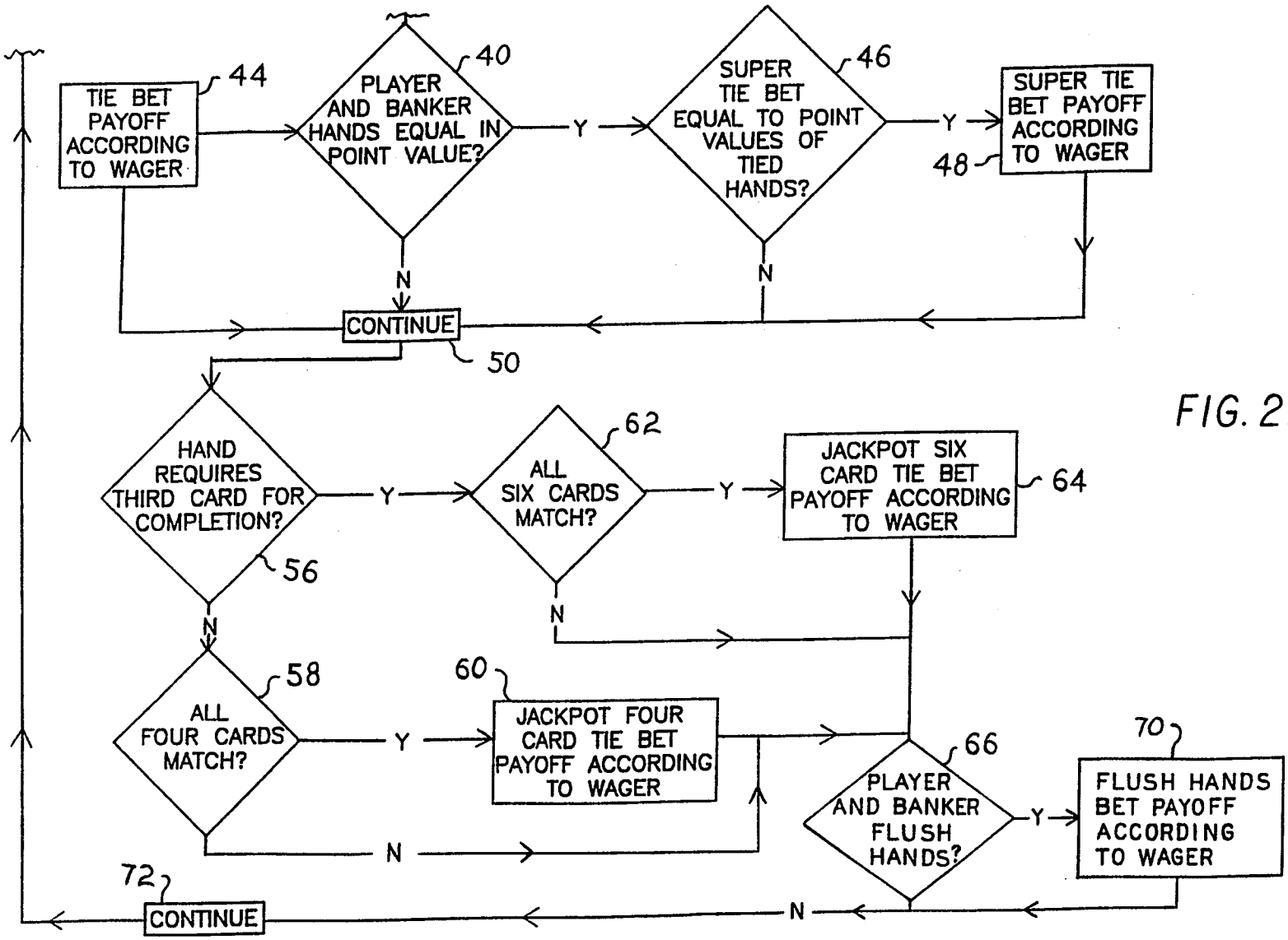
FIG. 2B is the second half of the flow chart of FIG. 1A.

Referring now to the drawings, the present invention will be seen to relate to various methods of providing wager options in a baccarat game. FIGS. 1A and 1B disclose a baccarat table 10, which includes provision for the various betting options of the present invention. FIGS. 2A and 2B disclose the various steps involved in placing wagers according to the present invention, and the relationship of the placement of those wagers to the play of the game. The present methods may be used in combination with a standard baccarat game using Nevada or other rules, wherein from twelve to fifteen players may play, and may also be adapted for use with so-called "mini-baccarat," which allows for play by from one to six players.

In standard, Nevada style baccarat, plural standard decks of cards, each having 52 cards of four suits, are used. The 13 cards in each suit comprise spot cards marked from one (ace) through ten, and court cards comprising the jack, queen, and king of the suit. Each of the spot cards is counted at face value, while each of the court cards is given a value of ten. Generally, six to eight decks are provided and contained in a "shoe" or container, from which the hands for the game are dealt.

In baccarat, only the players (as opposed to the house or casino) actually deal the cards, with the deal passing consecutively around the table (unless a player refuses the deal). The house "dealer" does not actually deal the cards (except in mini-baccarat), but rather acts as an overseer, caller and banker for the game. (More than one house dealer or banker is generally present, but for the purposes of the present explanation the house personnel overseeing the game will be considered as a single entity and referred to as the "caller" or "banker".) However, the player dealing the cards has no options in the play of the game, but must deal the cards for the two hands (called the "player" hand and the "bank" hand) according to the rigid rules of the game in accordance with the instructions of the caller or banker.

The object of the game is to achieve a total value of nine with the cards in each hand. It is impossible to "bust" or exceed that number, as the tens digit in any count exceeding nine is dropped, leaving only a single number between zero and nine (inclusive) as the value of the hand. The hand (either the single player hand or the bank hand) which is closest to nine, wins. As the game is relatively simple and must be played according to specific rules governing the drawing of a third card after the initial two cards are drawn, the present methods of betting or wagering on such baccarat hands add considerable interest and excitement to the game. As noted above, only two hands are initially dealt, with the single player hand representing all of the players in the game. However, any of the players (except the player dealing the cards, who under some rules must bet on the bank hand) are permitted to bet on either the player or the bank hand.

Initially, all of the players place their bets, for either the single player hand or the bank hand to win (i.e., to total closest to nine). Two cards are dealt face down for each of the two hands, as indicated in the first step of FIG. 2A, designated with the number 12, with at least the player hand then being turned face up as indicated in the second step 14 of FIG. 2A, so the value of the hand may be determined.

The present invention allows a player the option of "surrendering" a portion (generally half) of the initial bet at this point, rather than risking loss of the entire bet, for those players who have bet on the player hand. If the value of the player hand is either six or seven points, as indicated in the third step 16 of FIG. 2A (e.g., nine and eight equal seventeen, less the tens digit equals seven; king and six equal six; etc.), the player may surrender a portion of his/her bet if he/she wishes. The table 10 of FIGS. 1A and 1B provide for such by allowing a player to place half (or other designated portion) of his/her bet in that player's "surrender 2" area 18 of the table 10, whereupon the house collects the surrendered portion of the bet. According to the standardized rules of the game, the player hand must "stand" (i.e., cannot draw a third card in an attempt to come closer to nine) when the first two cards total six or seven. It will be seen that (if allowed), the probability of drawing a single card which would add only two or three points to the player hand is low; thus the option of surrendering a portion of a player bet, rather than risking the loss of the entire bet depending upon the outcome of the play of both hands, may prove attractive to some players at times. This option is provided for in the "Surrender Type II" block 20 of FIG. 2A.

Alternatively, both the player and the banker hands may be turned face up, according to the alternative second step 22 of FIG. 2A, with the players each having the option of surrendering a portion of their bets if both the player and the banker hand each total five or fewer points (e.g., queen and ten equal zero; eight and four equal twelve, less the tens digit equals two; etc.), in accordance with the alternative third step 24 of FIG. 2A. This would be a "Surrender Type 1" situation (step 26 of FIG. 2A), in which the player(s) wishing to do so would place a portion (again, generally one half, although other proportions may be agreed upon) of their bet(s) upon the "Surrender 1" area 28 of the table 10. This may be a desirable alternative for players, in that if the player hand has a count of five points and the banker hand has a count of zero or one point, the player has only four cards of each suit (ace through four) which could move the count closer to nine, whereas the banker hand could use eight or nine cards of each suit to raise the count closer to nine. Thus, the odds lie with the bank hand in such a situation, and the surrender option allows a player to give up only half (or other portion) of his/her wager, rather than continuing against the odds and losing the entire wager, in all probability.

It will be further noted that the provision of two different surrender options, type 1 and type II, have been abbreviated on the table 10 as "Surrender ½", which notation provides a mnemonic indication of the standard one half of the amount of the wager to be surrendered, in addition to providing for the placement of surrender 1 and II amounts.

It will be seen that play continues after each of the above surrender options, whether actually permitted by the card count and acted upon or not, through the continuation block 30 of FIG. 2A to a provision for wagering on a "natural" hand in block 32, and as provided for in the area 34 of the table 10. (The wager itself would be placed before dealing the cards; however, determination of whether a "natural" hand(s) has/have been dealt cannot be made until all four of the initially dealt cards for the two hands have been turned face up.) A "natural," in baccarat parlance, is a hand of two cards which have a total count of either eight or nine, and a player may make such a wager before the cards are dealt by placing an appropriate marker, e.g., one with that player's number on it corresponding to that player's table position, on the "natural" bar 34 of the table 10, or other means. Alternatively, each player position could have a "natural" betting position thereon, as well as provision for the other wagering options of the present invention, if desired.

While it is not wished to include any specific payoff odds in combination with the above provision for "natural" bets, it has been found that a nine to one payoff results in a favorable edge for the house, as four of the thirteen cards in each suit have zero value. Thus, the odds will be seen to be greater than nine to one against the deal of a two card "natural" of eight or nine. Other payoff odds may be provided as desired. In the event of a winning wager on a "natural" hand(s), a payoff is made as indicated by block 36 of FIG. 2A, the game continues to block 38 of FIG. 2A, and thence to the provision for wagers on tie hands, indicated in the option block 40 of FIG. 2B.

Normally, either the bank hand or the player hand will have a count closest to nine. However, the game does not preclude tie hands, in which both hands are equal in value. This is generally known as a "push." The present invention provides for a player to bet upon the occurrence of such a "push," not only generally, but for a specific, predetermined value of the hands. Thus, the present invention not only allows wagers on the possibility of a tie, but also on a "super tie," in which the occurrence of a specific count for each of the hands is also bet upon. In the event a player wishes to make such a bet, he/she may place an appropriate marker on the "super tie" bar 42 of the table 10, as shown in FIGS. 1A and 1B, on the number corresponding to the specific tie count being bet upon. (The counts provided range from zero through 7, as the occurrence of naturals of eight or nine in the player hand win automatically.) Again, alternative means of indicating the placement of such a wager may be provided.

Assuming the bank and player hands are equal in count, a tie bet payoff may be provided as indicated in the block 44 of figure 2B. This does not constitute a "super tie" payoff, unless a wager was placed for a tie to occur at a specific point count for each hand, and a tie occurs with each hand having that specific point count, as indicated by the "super tie" bet block 46 of FIG. 2B. If the two hands each have a count equal to that wagered upon in the super tie bet of block 46, then a payoff is made in accordance with block 48 of FIG. **2*b*, and the game continues as indicated by block 50 of FIG. 2B**. While no specific payoff odds are described herein, it will be seen that a super tie bet in which a tie at a specific count must occur is a subset of all tie hands, and payout may be provided accordingly.

The above "super tie" provision makes no specific provision for the total number of cards in either hand. However, the standard rules of baccarat make provision for the dealing of a third card to the bank and/or player hands under certain circumstances, depending upon the count of the first two cards. (i.e., player hands having counts of zero through five must draw a third card, while player hands having counts of six through nine must "stand". The bank hand must draw a third card or stand, depending upon both the count of the first two cards of the bank hand, and/or the value of the third card of the player hand, if such a third card is required.) Accordingly, the above described "super tie" bets may be made when either hand has either two or three cards, depending upon any requirement for the draw of a third card for either hand.

The present invention also includes the provision for betting on the occurrence of like cards in such tie hands, comprising a total of either four, five, or six cards for both hands. In other words, a player may bet upon the chance of four, five, or six of a kind being dealt, either generally or specifically (e.g., all fours or all sevens, etc.); this is known as a "jackpot tie." (Casino baccarat provides for more than the four equally valued cards of the four suits of a standard deck, due to the fact that multiple decks are shuffled and dealt from the "shoe," or card container.) As the rules governing the drawing of a third card for either hand are quite specific, a four card "jackpot tie" may only occur with spot card threes, fours, eights, and nines, while a six card "jackpot tie" may only occur with spot card aces (ones), twos, fives, sixes, and sevens, and cards having a value of zero (tens, jacks, queens, and kings).

A player may wager on the likelihood of such a four or six card jackpot tie by placing his/her marker on the respective four or six card jackpot tie bar 52 or 54 of the table 10 of FIGS. 1A and 1B, or using alternative means such as individual jackpot tie placements for each player. A player may bet upon the occurrence of four or six of a specific value card, the occurrence of any four or six of a kind, or the occurrence of all face cards in the two hands, as desired and indicated in the jackpot tie area of the table 10 of FIGS. 1A and 1B.

The occurrence of either a four or six card jackpot tie will initially be based upon the need for a third card to complete each of the hands, as indicated in the third card alternative block 56 of FIG. 2B. Assuming that the two hands each have a count of six or eight, the player and the bank hands must both stand, i.e., not draw a third card. If the four cards do not match, as provided for in the alternative block 58 of FIG. 2B, the game may continue as indicated. However, if the four cards are all threes, fours, eights, or nines, then provision is made for a four card jackpot tie payoff, in accordance with block 60 of FIG. 2B. (In accordance with the standard rules of baccarat, a hand containing threes, fours, eights, or nines will have a count of either six or eight, since the tens digit is dropped for totals exceeding ten. Such a hand must stand; hence, the provision for only those cards in the four card jackpot tie bar 52 of the table 10 of FIGS. 1A and 1B.)

In the event of the need to draw a third card for each hand, as provided for by the alternative branch of the block 56 of FIG. 2B, the possibility of a six card jackpot tie may exist. According to the rules of baccarat, the player hand must draw a card when the first two cards total zero through five. A pair of face cards (or tens), aces, twos, fives, sixes, or sevens (with the tens digit dropped for the total of two fives, sixes, or sevens), will be seen to require the drawing of a third card, and accordingly cards having those values are provided for in the six card jackpot tie bar 54 of the table 10 of FIGS. 1A and 1B. If the third card (or the initial two, for that matter) does not match to form three of a kind for each hand, with the two hands matching to form six of a kind, then no six card jackpot tie exists. However, in the event that all six cards match, as provided for by the alternative block 62 of FIG. 2B, a jackpot six card tie bet payoff will be provided, as indicated in the box 64 of FIG. 2B.

The above described jackpot tie bets may be provided for as "hop" bets, which bets are in effect for the play of only one hand. If a player desires to maintain such a bet, it must be renewed prior to the dealing of each hand. Alternatively, such a bet may be placed as a "future" bet, which wager will remain active for the entire "shoe" of cards. Such "hop" and "future" alternatives may be provided for any of the bets of the present invention, as desired.

Yet another option is the provision for betting upon the occurrence of "flush" player and banker hands, i.e., both hands comprising cards of the same suit, provided for in the alternative block 66 of FIG. 2B; wagers for such an occurrence may be placed using the "4-5-6 Card Flush" bar 68 of the table 10 of FIGS. 1A and 1B, in the manner described above for other wagers. As either hand may contain either two or three cards, the flush hand betting option covers a card total for both hands of either four, five, or six cards, and does not consider whether the player or bank hand contains three cards when the two hands comprise a total of five cards. In other words, the number of cards forming the two hands is immaterial, so long as all cards are of the same suit. Assuming that such flush hands occur, payoff may be made according to wagers made before the hands were dealt, in accordance with the flush hands payoff block 70 of FIG. 2B.

At this point, the various possibilities and options for betting on a given baccarat hand have been completed, and the game may continue to the dealing of another hand, as indicated by the continuation block 72 of FIG. 2B, which indicates a path back to the block 12 of FIG. 2A referring to the dealing of the two hands. As most casino games are essentially continuous, the game may be played, and the above wagers placed according to the desires of the players, so long as there are players who wish to play; players may enter and leave the game essentially at any point. The above wagering options and methods of wagering on the game of baccarat will be seen to provide considerable additional interest an excitement in what is essentially a relatively simple game, which relies to a great extent upon an aura and glamour developed over years of tradition to draw players. The provision for bets on the occurrence of two card counts of eight or nine ("naturals"); tie bets specifying a count for the hands ("super ties"); four or six of a kind forming the two hands ("jackpot ties"); and flush hands, will be seen to provide numerous additional possibilities to attract additional players, as well as additional revenue for a casino or other operation providing such a game.

It is to be understood that the present invention is not limited to the sole embodiment described above, but encompasses any and all embodiments within the scope of the following claims.

I claim:

1. A method of wagering on a baccarat game, including such game variations as standard baccarat, Chemin de Fer, Nevada-style baccarat, Scarney baccarat, baccarat banque, and mini-baccarat, said method comprising the following steps:

dealing a hand of playing cards face down from at least one standard deck of playing cards comprising four suits of spot cards with numbers from one through ten and court cards comprising jacks, queens, and kings; with each of the spot cards having a value equal to the number of the corresponding spot card and each of the court cards having a value of ten, to form at least one player hand and a bank hand of at least two cards each; then turning said at least two cards of said at least one player hand face up whereby players making bets may view said cards; and then providing an opportunity to said players making bets on said player hand to surrender a portion of their bets if a sum of the value of said at least two cards of said player hand is from six to seven inclusive;

wherein said players who actually surrender a portion of their bets are no longer allowed to continue play of said hand.

2. A method of wagering on a baccarat game according to claim 1, further comprising the subsequent steps of:

turning said at least two cards of said bank hand face up whereby remaining players making bets may view said cards; and then providing an opportunity to said remaining players making bets on said player hand to surrender a portion of their bets if a sum of the value of said at least two cards of said bank hand and the sum of the value of said at least two cards of said player hand are each less than six, respectively;

wherein said players who actually surrender a portion of their bets are no longer allowed to continue play of the hand.

3. A method of wagering on a baccarat game according to claim 1, further comprising the step of:

subsequent to said dealing of said playing cards, and prior to turning any of said playing cards face up, providing an opportunity to players to bet upon the occurrence of a natural hand in said player hand.

4. A method of wagering on a baccarat game according to claim 1, further comprising the step of:

subsequent to said dealing of said playing cards, and prior to turning any of said playing cards face up, providing an opportunity to players to bet upon the occurrence of a tie between the sum of the value of said at least two cards of said player hand and the sum of the value of said at least two cards of said bank hand.

5. A method of wagering on a baccarat game according to claim 4, further comprising the step of:

subsequent to said dealing of said playing cards, and prior to turning any of said playing cards face up, providing an opportunity to players to bet upon the occurrence of a super tie, wherein the sum of the value of said at least two cards of said player hand and the sum of the value of said at least two cards of said bank hand are identical and a specific numeric value for the sum of the respective values of the cards of the tied player and banker hands is specified by said players.

6. A method of wagering on a baccarat game according to claim 4, further comprising the step of:

subsequent to said dealing of said playing cards, and prior to turning any of said playing cards face up, providing an opportunity to players to bet upon the occurrence of a jackpot tie wherein the spot or court cards of said player hand are identical to each other and also identical to the spot or court cards of said bank hand, and the identity of identical spot or court cards of said player hand and said bank hand is specified by said players.

7. A method of wagering on a baccarat game according to claim 5, further comprising the step of:

subsequent to said dealing of said playing cards, and prior to turning any of said playing cards face up, providing an opportunity to players to bet upon the occurrence of a jackpot tie, wherein the spot or court cards of said player hand are identical to each other and also identical to the spot or court cards of said bank hand, and the identity of identical spot or court cards of said player hand and said bank hand is specified by said players.

8. A method of wagering on a baccarat game according to claim 6, wherein the jackpot tie bet is a hop bet and the jackpot tie hop bet is valid for only a single hand of play.

9. A method of wagering on a baccarat game according to claim 6, wherein the jackpot tie bet is a future bet, and the jackpot tie future bet is valid for all hands dealt from the at least one standard deck of playing cards before the at least one deck is reshuffled.

10. A method of wagering on a baccarat game according to claim 7, wherein the jackpot tie bet is a hop bet, and the jackpot tie hop bet is valid for only a single hand of play.

11. A method of wagering on a baccarat game according to claim 7, wherein the jackpot tie bet is a future bet, and the jackpot tie future bet is valid for all hands dealt from the at least one standard deck of playing cards before the at least one deck is reshuffled.

12. A method of wagering on a baccarat game according to claim 1, further comprising the step of:

subsequent to said dealing of said playing cards, and prior to turning any of said playing cards face up, providing an opportunity to players to bet upon the occurrence of a flush wherein the suits of the at least two cards of the player hand are identical to each other and also identical to the at least two cards of the bank hand.

* * * * *